US005642787A

United States Patent [19]

Hutchinson

[11] Patent Number: 5,642,787

[45] Date of Patent: Jul. 1, 1997

[54] SECTION MILLING

[75] Inventor: Christopher P. Hutchinson, Houston, Tex.

[73] Assignee: Weatherford U.S., Inc., Houston, Tex.

[21] Appl. No.: 532,473

[22] Filed: Sep. 22, 1995

[51] Int. Cl.[6] ..... E21B 10/26

[52] U.S. Cl. ..... 175/269; 166/55.8

[58] Field of Search ..... 166/55.8; 175/269, 175/263

[56] References Cited

U.S. PATENT DOCUMENTS

| | | | |
|---|---|---|---|
| 2,389,235 | 11/1945 | Harrison | 164/0.8 |
| 2,481,637 | 9/1949 | Yancey | 164/0.8 |
| 2,644,670 | 7/1953 | Baker et al. | 255/61 |
| 2,690,217 | 9/1954 | Robishaw | 164/0.7 |
| 2,863,641 | 12/1958 | Kammerer | 166/55.8 X |
| 2,899,000 | 8/1959 | Medders et al. | 166/55.8 |
| 3,195,636 | 7/1965 | Cordary et al. | 166/55.8 |
| 3,224,507 | 12/1965 | Cordary et al. | 175/269 X |
| 3,331,439 | 7/1967 | Sanford | 166/55.8 |
| 3,351,144 | 11/1967 | Park | 175/269 |
| 3,419,077 | 12/1968 | Sanford | 166/55.8 |
| 4,119,151 | 10/1978 | Smith | 166/298 |
| 4,431,065 | 2/1984 | Andrews | 175/269 |
| 4,646,826 | 3/1987 | Bailey et al. | 166/55.3 |
| 4,796,709 | 1/1989 | Lynde et al. | 166/55.6 |
| 4,809,793 | 3/1989 | Hailey | 175/265 |
| 4,887,668 | 12/1989 | Lynde et al. | 166/55.8 |
| 4,938,291 | 7/1990 | Lynde et al. | 166/55.8 |
| 4,978,260 | 12/1990 | Lynde et al. | 166/55.6 |
| 4,984,488 | 1/1991 | Lunde et al. | 166/55.6 |
| 5,014,778 | 5/1991 | Lynde et al. | 166/55.6 |
| 5,014,780 | 5/1991 | Skipper | 166/55.8 |
| 5,018,580 | 5/1991 | Skipper | 166/298 |
| 5,038,859 | 8/1991 | Lynde et al. | 166/55.6 |
| 5,058,666 | 10/1991 | Lynde et al. | 166/55.6 |
| 5,086,838 | 2/1992 | Cassel et al. | 166/55.6 |
| 5,086,852 | 2/1992 | Van Buskirk | 175/269 |
| 5,150,755 | 9/1992 | Cassel et al. | 166/297 |
| 5,199,513 | 4/1993 | Stewart et al. | 175/73 |
| 5,201,817 | 4/1993 | Hailey | 175/269 |
| 5,242,017 | 9/1993 | Hailey | 166/55.8 |
| 5,265,675 | 11/1993 | Hearn et al. | 166/297 |
| 5,297,630 | 3/1994 | Lynde et al. | 166/297 |
| 5,350,015 | 9/1994 | Hailey | 166/55.8 |
| 5,373,900 | 12/1994 | Lynde et al. | 166/297 |
| 5,385,205 | 1/1995 | Hailey | 166/55.8 |
| 5,456,312 | 10/1995 | Lynde et al. | 166/55.6 |

OTHER PUBLICATIONS

"1990—91 General Catalog," A-1 Bit & Tool Co., p. 10, 1990.

"General Catalog 68—69," A-1 bit & Tool Co., pp. 131, 133, 142; 1968.

"1976—77 General Catalog," A-1 Bit & Tool Co., pp. 110, 111, 123, 124; 1976.

*Primary Examiner*—William P. Neuder

*Attorney, Agent, or Firm*—Guy McClung

[57] ABSTRACT

Section mills have been invented that have one or more blades whose tops are rotatably extendable outward from a mill body as bottoms of the blade(s) rotate about a fixed point, the blade bottoms rotatably secured to the mill body so that, in response to a downwardly moving wash tube contacting the blades, tops of the blades move out from the mill body. In one aspect the blades have a milling surface which is of such an outward extent and which is parallel to a central longitudinal axis of the mill body when the blades are fully extended so that the blades achieve "full sweep" milling.

16 Claims, 7 Drawing Sheets

SECTION MILLING

BACKGROUND OF THE INVENTION

1. Field of the Invention

This invention is related to wellbore section milling methods, section milling tools, and blades for such tools.

2. Description of Related Art

The prior art discloses various types of milling or cutting tools provided for cutting or milling a section of existing pipe or casing previously installed in a well. These tools have movable cutting blades and are lowered into the well or casing, the blades are deployed from the tool, and then the tool is rotated in a cutting operation. With certain tools, a suitable drilling fluid is pumped down a central bore of a tool for discharge beneath the cutting blades and an upward flow of the discharged fluid in the annulus outside the tool removes from the well cuttings or chips resulting from the cutting operation.

Milling tools have been used for removing a section of an existing tubular, e.g. casing from a well bore, to permit a sidetracking operation in directional drilling; in open hole gravel packing operations; to open a section for injection; and to provide a perforated production zone at a desired level.

Typically only a portion of a blade's milling surface actually mills the tubular during a milling operation and, as the portion is worn away, another portion of the blade commences milling. This can result in relatively extended time period for completing milling of a desired section of casing.

There has long been a need for efficient and effective section milling methods and a section mill useful in such methods. There had long been a need for a section mill blade with increased milling capability. There has long been a need for a mill that covers a coupling's total width for life of the blade.

SUMMARY OF THE PRESENT INVENTION

The present invention, in one embodiment, discloses a section mill with one or more blades which initially are substantially contained within a hollow part of a mill body. A wash tube disposed above the blade or blades is forced downwardly by the pressure of circulating fluid. The wash tube moves between the blade(s), contacting them, forcing them apart, and moving them out from the hollow mill body. The blade(s) rotate on pins which pin the blade(s) at the bottom to the hollow mill body so that the tops of the blade(s) rotate outwardly and downwardly from within the hollow mill body.

In one aspect a flow nozzle is used with the wash tube. The flow nozzle has a fluid flow bore therethrough that is in fluid communication with a fluid flow bore through the wash tube. The flow nozzle is mounted in a nozzle sleeve which is above and in contact with a top surface of the wash tube. A spring biases the wash tube away from the blades and the spring force opposes the force of fluid flowing through the sleeve and against the wash tube. Part of the fluid force on the top of the wash tube is dissipated due to the flow of a portion of the fluid through the flow nozzle, down through the wash tube, past the blades, and out through a bottom flow bore in the hollow mill body. At the lower limit of its travel the wash tube is separated from the flow sleeve and flow nozzle and fluid is permitted to flow through a space between the exterior of the flow nozzle and the interior of the wash tube; and there is a pressure drop indicating that the blade(s) have been moved and extended to their operative position. In other aspects the flow nozzle and sleeve are not used; e.g. when running a mud motor with the mill, when a bypass valve is used which is integral with the mud motor or is on the mill body.

In one aspect the wash tube has no flat sides, or has one or more flat sides and a pin with a corresponding flat end extends through the hollow mill body to abut the flat side of the wash tube to maintain its orientation within the hollow mill body. In one aspect three flat sides and one pin are used.

The present invention discloses a "full sweep milling" blade for a section mill, the blade having a body and a blade thereon which are sized and configured to be held substantially within the hollow mill body until moved therefrom by the descending wash pipe. The blade itself, in one aspect, has an outer surface which is held in a position substantially parallel to the longitudinal axis of the hollow mill body when the blade is fully extended—thus insuring that a major portion of the blade's exterior milling surface (and, in certain preferred embodiments, substantially all of said surface) contacts the tubular to be milled. The provision of side-by-side longitudinal rows of cutting inserts on such a blade further facilitates "full sweep" milling by a major portion of the blade. The blades' interior surfaces are appropriately sized, disposed, and configured for receiving therebetween a nose of a lower end of the wash pipe. When milling a coupling (e.g. coupling C, FIG. 1B), such a full-sweet blade mills the total coupling width ("w" in FIG. 1B) even as the blade is worn away.

In one aspect the blades have a pin recess which moves about a retaining pin secured to the hollow mill body. When the blades are correctly positioned exteriorly of the hollow mill body an inner end of this pin recess abuts a retaining pin so that further outward blade movement is impossible and the blade is maintained in the correct position for milling.

To facilitate milling and maintain a milling tool in correct position for milling, certain systems according to the present invention include one or more stabilizer apparatuses above and/or below the milling blades. In one aspect such stabilizers are formed integrally of the milling body or of couplings or other members connected to the milling body. In another aspect the stabilizers include wear pieces that are removably and replaceably secured either to the milling body itself or items connected thereto. In one aspect a remotely actuated stabilizer or stabilizers are used either above and/or below the milling body.

Any surface or part of systems according to the present invention may be treated, sleeved, coated, overlaid, or hardfaced with wear-resistant material to resist erosion, including but not limited to, internal surfaces within the tool which are contacted by erosive and corrosive well fluids. In one aspect a wash tube is made of multiple parts including an inlet end and an outlet end made of wear resistant material (e.g., but not limited to, stainless steel, carbide, steel, and cobalt-based. The remaining mid-portion of the wash tube may be made of steel or a steel alloy.

In one aspect a milling system according to the present invention includes a downhole motor connected to the mill for rotating it. Appropriate stabilizers may also be used with such a mill and motor.

In one aspect the fluid flowing through a system according to the present invention is typical wellbore drilling mud flowing at a rate of 200 feet per minute annular velocity at less than 3500 psi.

The present invention discloses, in certain embodiments, a milling apparatus with a hollow mill body, at least one blade within the hollow mill body the or each blade having a blade body a top, a bottom, and a cutter with a cutting surface, the or each blade bottom rotatably secured by a securement to the hollow mill body for rotation outwardly from the hollow mill body, and apparatus for moving the at least one blade from the body; such an apparatus wherein the apparatus for moving the at least one blade from the body is a wash tube movably disposed in the hollow mill body above the at least one blade, the wash tube movable downwardly in response to the force of fluid flowing into the section milling apparatus to contact the at least one blade and move the top of the at least one blade outwardly from the hollow mill body as the at least one blade rotates about its securement, the wash tube having a tube central flow channel for the flow of fluid therethrough; such an apparatus wherein the cutting surface of the cutter of the at least one blade has a longitudinal length extending out from the blade body such that the cutting surface provides full sweep milling for substantially the entire longitudinal length of the cutting surface and is able to mill a coupling's full width along substantially all of the blade's length.

The present invention also discloses, in certain embodiments, a blade for a milling apparatus, the blade disposable within and movable outwardly from the milling apparatus, the blade having a blade body with a top and a bottom, an interior surface, and an exterior surface; a milling surface on the exterior surface of the blade body; a first angled surface on an interior of the blade body for contacting and co-acting with a second angled surface on an exterior of a lower end of an actuating member in the milling apparatus, the second angled surface corresponding to and for contacting the first angled surface on the interior of the blade body so that as the actuating member moves downwardly the blade is moved outwardly from the milling apparatus; such a blade having a second surface on its interior for contacting the actuating member so that when the blade is moved to a milling position the second surface is substantially parallel to an exterior surface of the actuating member so that the blade is held in the milling position by the actuating member; and such a blade with stop means on the blade body for contacting another member to stop movement of the blade out from the milling apparatus.

The present invention discloses a milling method including: introducing a milling apparatus into a casing to be milled, the milling apparatus comprising a hollow mill body, at least one blade within the hollow mill body, the or each blade having a top, a bottom, and a cutting surface, the or each blade bottom rotatably secured by a securement to the hollow mill body for rotation outwardly from the hollow mill body, and apparatus for moving the at least one blade from the body,; positioning the milling apparatus at a desired location in the casing; moving the apparatus for moving the at least one blade downwardly to move the at least one blade outwardly from the hollow mill body against an interior of the casing; and rotating the milling apparatus to mill the casing with the at least one blade. One such method also includes effecting full sweep milling of the casing, the cutting surface of the at least one blade having an extension out from the blade body, said extension such that the cutting surface of the at least one blade provides full sweep milling for substantially an entire longitudinal length of the cutting surface.

It is, therefore, an object of at least certain preferred embodiments of the present invention to provide:

New, useful, unique, efficient, non-obvious section milling tools, blades for such section milling tools, and methods for section milling operations;

Such tools which effect "full sweep" or nearly "full sweep" contact between an exterior blade milling surface and part of a tubular to be milled; in one aspect, such a blade and tool which can fully mill a coupling even as the blade is worn down;

Such tools in which a wash tube descends between movable blades, moving them apart and to a desired milling position;

Such tools in which a blade exterior milling surface is substantially parallel to a longitudinal axis of a mill; and Such tools in which the bottoms of the blades are rotatably pinned to a mill body so that the wash tube moves the tops of the blades outwardly; such tools with apparatus for arresting blade outward movement at a desired extent and position; and such tools with apparatus for urging blades back into the tool.

This invention resides not in any particular individual feature disclosed herein, but in combinations of them and it is distinguished from the prior art in these combinations with their structures and functions. There has thus been outlined, rather broadly, features of the invention in order that the detailed descriptions thereof that follow may be better understood, and in order that the present contributions to the arts may be better appreciated. There are, of course, additional features of the invention that will be described hereinafter and which may be included in the subject matter of the claims appended hereto. Those skilled in the art who have the benefit of this invention will appreciate that the conceptions, upon which this disclosure is based, may readily be utilized as a basis for the designing of other structures, methods and systems for carrying out the purposes of the present invention. It is important, therefore, that the claims be regarded as including any legally equivalent constructions insofar as they do not depart from the spirit and scope of the present invention.

The present invention recognizes and addresses the previously-mentioned problems and needs and provides a solution to those problems and a satisfactory meeting of those needs in its various possible embodiments and equivalents thereof. To one of skill in this art who has the benefits of this invention's realizations, teachings and disclosures, other and further objects and advantages will be clear, as well as others inherent therein, from the following description of presently-preferred embodiments, given for the purpose of disclosure, when taken in conjunction with the accompanying drawings. Although these descriptions are detailed to insure adequacy and aid understanding, this is not intended to prejudice that purpose of a patent which is to claim an invention as broadly as legally possible no matter how others may later disguise it by variations in form or additions of further improvements.

Filed on even-date herewith and co-owned with the present invention are U.S. Applications entitled "Wellbore Sidetracking Methods And Apparatuses" naming Schnitker et al as inventors, and "Wellbore Milling Tools And Inserts" naming the present inventor, both of which are incorporated fully herein for all purposes.

DESCRIPTION OF THE DRAWINGS

So that the manner in which the above-recited features, advantages and objects of the invention, as well as others which will become clear, are attained and can be understood in detail, more particular description of the invention briefly summarized above may be had by references to certain embodiments thereof which are illustrated in the appended drawings, which drawings form a part of this specification.

It is to be noted, however, that the appended drawings illustrate certain preferred embodiments of the invention and are therefore not to be considered limiting of its scope, for the invention may admit to other equally effective or equivalent embodiments.

DESCRIPTION OF EMBODIMENTS PREFERRED AT THE TIME OF FILING FOR THIS PATENT

Figure 1A:
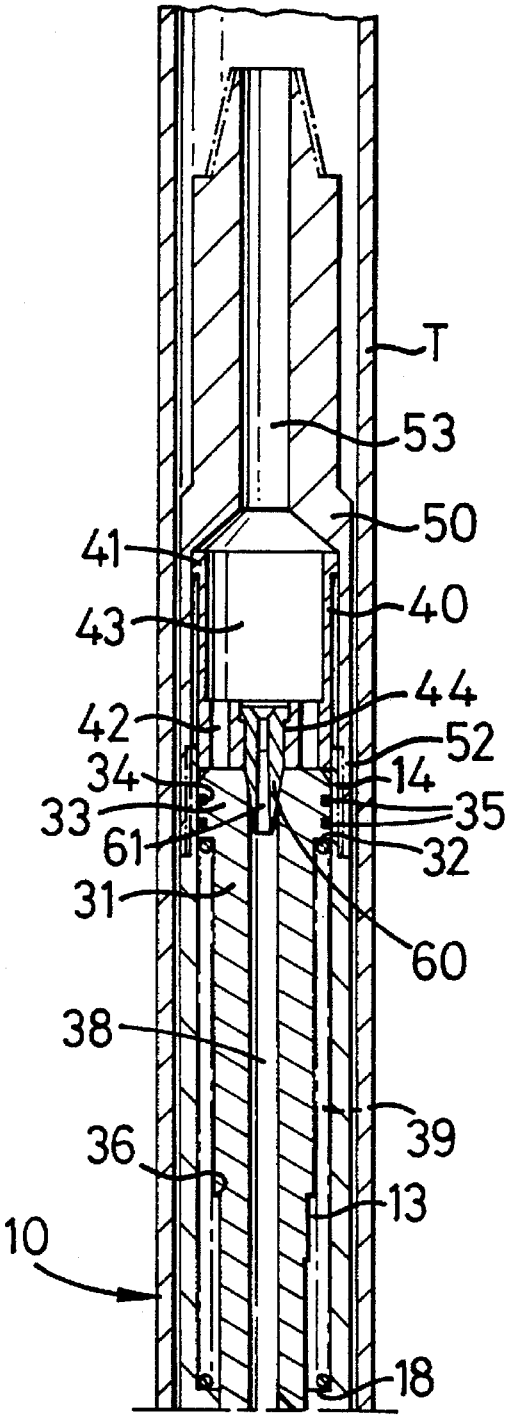
FIG. 1A is a side view in cross-section of a milling system according to the present invention.
Figure 1A:
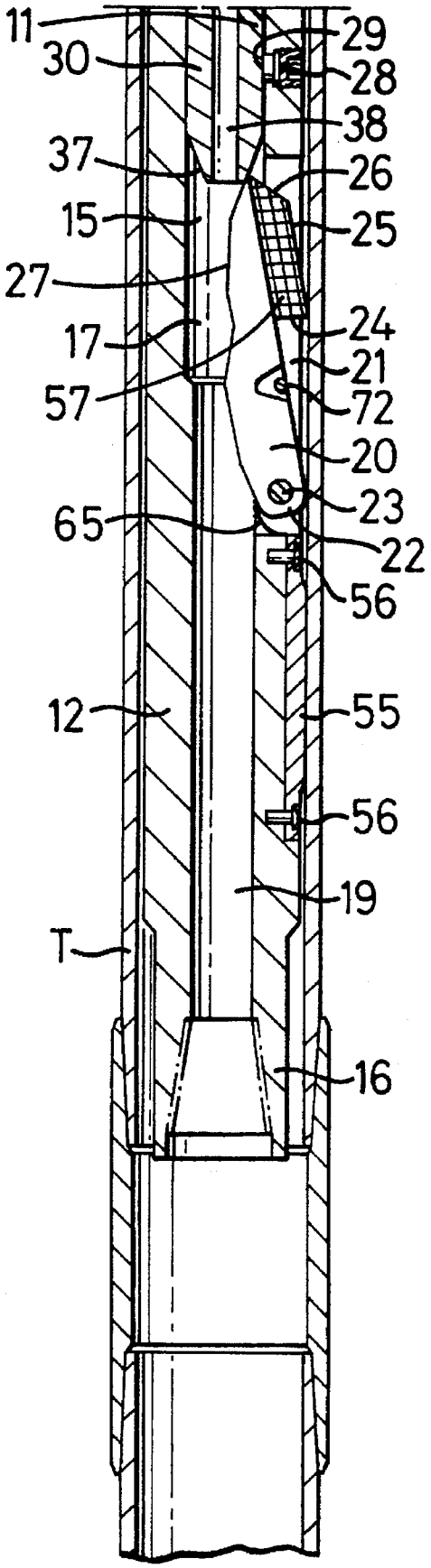

Referring now to FIGS. 1A–1D, a milling system 10 according to the present invention in a tubular T (e.g. pipe, casing or tubing) has a hollow mill body 12 with a threaded top end 14, a threaded bottom end 16, a top hollow chamber 13, a middle hollow chamber 15, and a fluid flow bore 17 with a bottom portion 19.

Three blades 20 are initially disposed in respective slots 21 in the hollow mill body 12, each with a bottom end 22 rotatably pinned by a pin 23 to the hollow mill body 12. Each blade has cutting or milling surfaces 24, 25, and 26 and interior surfaces generally designated by the numeral 27 and fully described below. A spring 65 urges each blade 20 inwardly.

A wash tube 30 has a top portion 31 movably disposed in the top hollow chamber 13 and biased upwardly by a spring 39 which abuts a top shoulder 32 of the wash tube 30 and an interior shoulder 18 of the hollow mill body 12. A top end 33 of the wash tube 30 has recesses 34 in which are disposed seals 35 (e.g. commercially available Polypak™ seals, O-rings, or combinations thereof) for sealing an interface between the exterior surface of the wash tube 30 and the interior surface of the top hollow chamber 13. A shoulder 36 of the wash tube 30 is disposed to contact the interior shoulder 18 of the hollow mill body 12 to prevent further downward movement of the wash tube 30 (see FIG. 1B). In certain preferred embodiments the wash tube 30 has a lower end 37 in the form of a conical, tapered nose for contacting and co-acting with the blades 20. A fluid flow bore 38 extends through the wash tube 30 from top to bottom. One or more pins 28 extending through the hollow mill body 12 abuts a flat surface 29 on the wash tube 30 to maintain the wash tube 30 in position in the hollow mill body 12. The wash tube may have a circular cross-section with no, one, or more flat surfaces. The wash tube 30 may move up and down with respect to the pins 28.

A flow sleeve 40 is movably disposed in a chamber 51 in a top sub 50. The top sub 50 has a lower threaded end 52 which is threadedly mated to the top end 14 of the hollow mill body 12. The flow sleeve 40 has a top shoulder 41 which abuts the top end 14 of the hollow mill body 12 to prevent further downward movement of the flow sleeve 40. Flow holes 42 through the flow sleeve 40 are in fluid communication with an upper fluid flow bore 43 of the flow sleeve 40.

A fluid flow nozzle 60 is disposed in a central bore 44 of the flow sleeve 40. The flow nozzle 60 has a central fluid flow bore 61 which initially (FIG. 1A) is in fluid communication with the fluid flow bore 38 of the wash tube 30 and sealingly contacts the top of the wash tube 30. The top sub 50 has a central fluid flow bore 52 therethrough from top to bottom which is in fluid communication with the chamber 51. The internal diameter of the fluid flow nozzle 60 is sized to achieve a desired pressure drop across the nozzle and so that the pressure is sufficiently high to achieve "cut out," i.e. fully extend the blades and cut through the casing (e.g.. see FIG. 1C).

Initially the flow sleeve 40 and the wash tube 30 are held up by the force of the spring 39. When the force of the fluid reaches a level sufficient to overcome the spring force, the fluid pushes on the flow sleeve 40 which pushes on the wash tube 30 moving it downwardly so that the lower nose end 37 of the wash tube 30 moves down between the blades 20 pushing them apart and out from their respective slots 21 (FIG. 1B). As the wash tube 30 moves further down within the hollow mill body 12, the blades 20 move further outwardly, rotating about the pins 23. The shoulder 36 of the wash tube 30 moves to abut the interior shoulder 18 of the hollow mill body 12 and outward movement of the blades 20 effected by the wash pipe 30 ceases.

The shoulder 36 moves against the shoulder 18, the top shoulder 41 of the flow sleeve 40 abuts the top end 14 of the hollow mill body 12, and downward movement of the flow sleeve 40 ceases. Fluid pressure on the top end 33 of the wash tube 30 moves it down into the position shown in FIG. 1D.

Figure 1B:
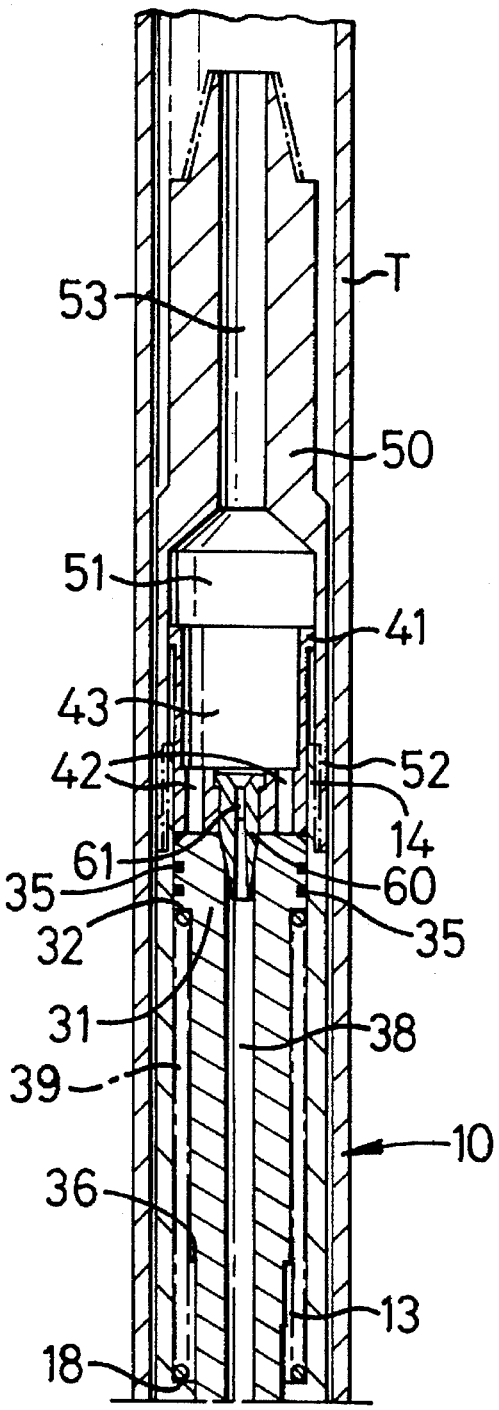
FIG. 1B is another side view in cross-section of the milling system of FIG. 1A.
Figure 1B:
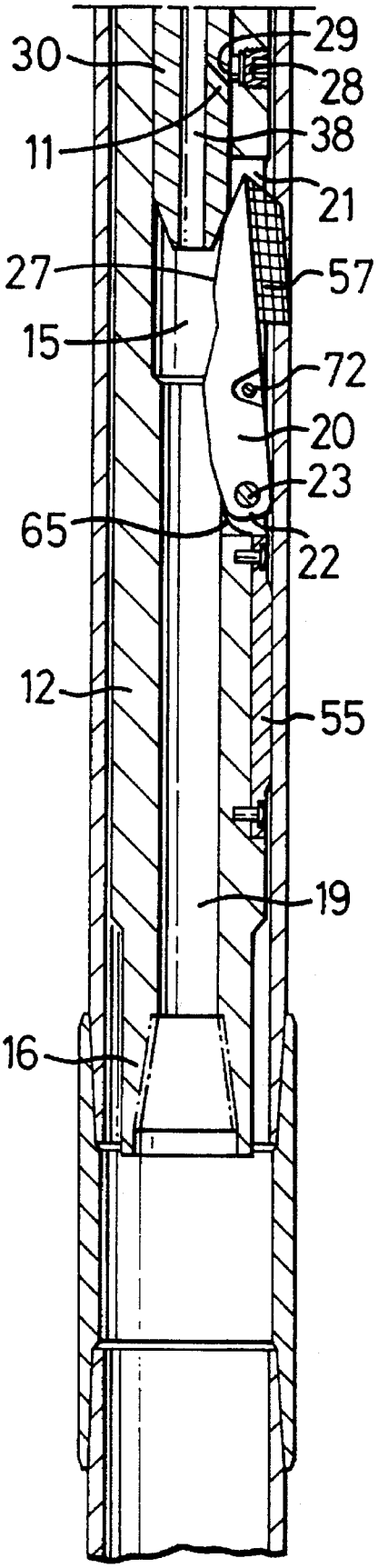
Figure 1C:
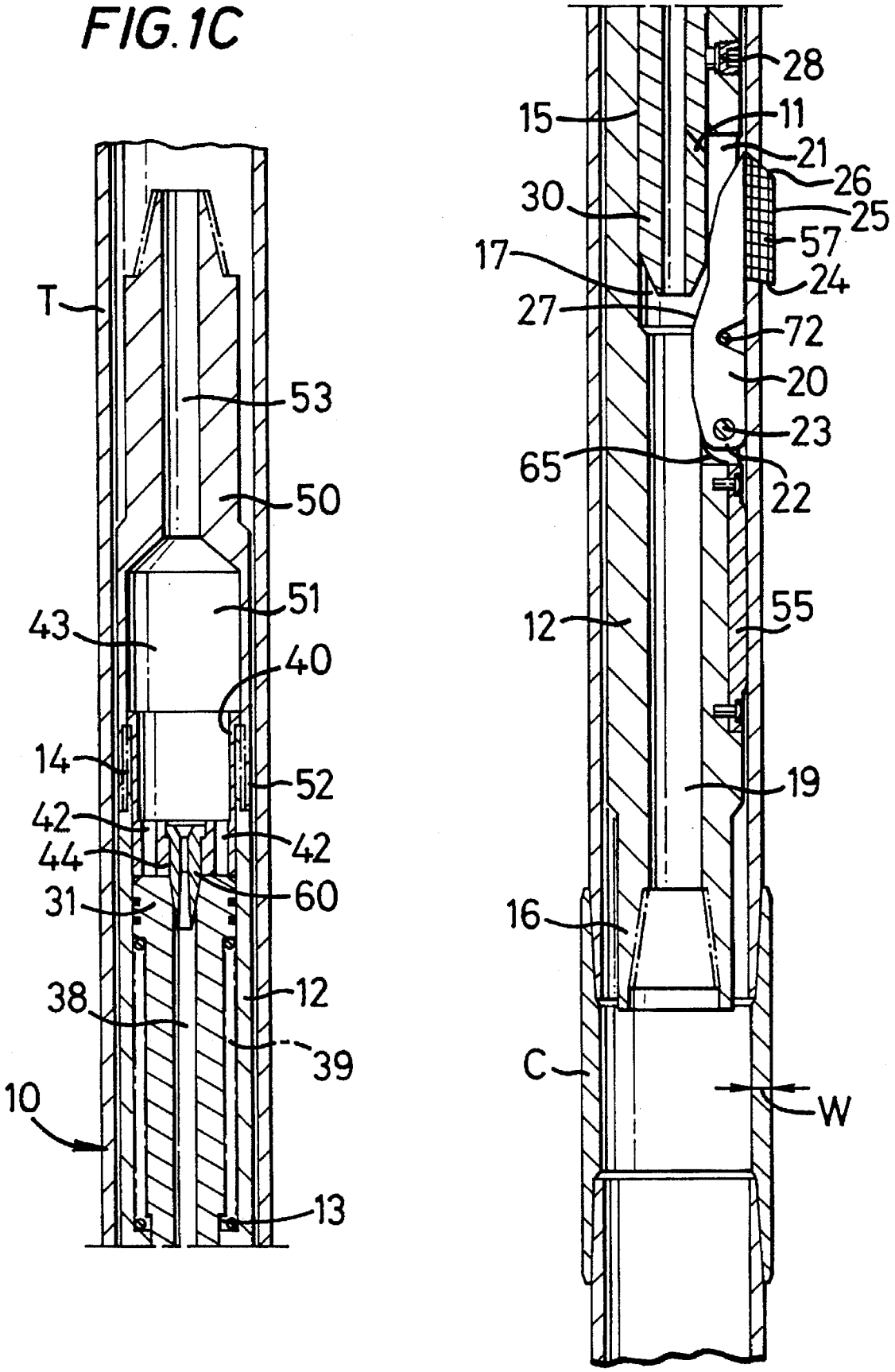
FIG. 1C is another side view in cross-section of the milling system of FIG. 1A.
Figure 1D:
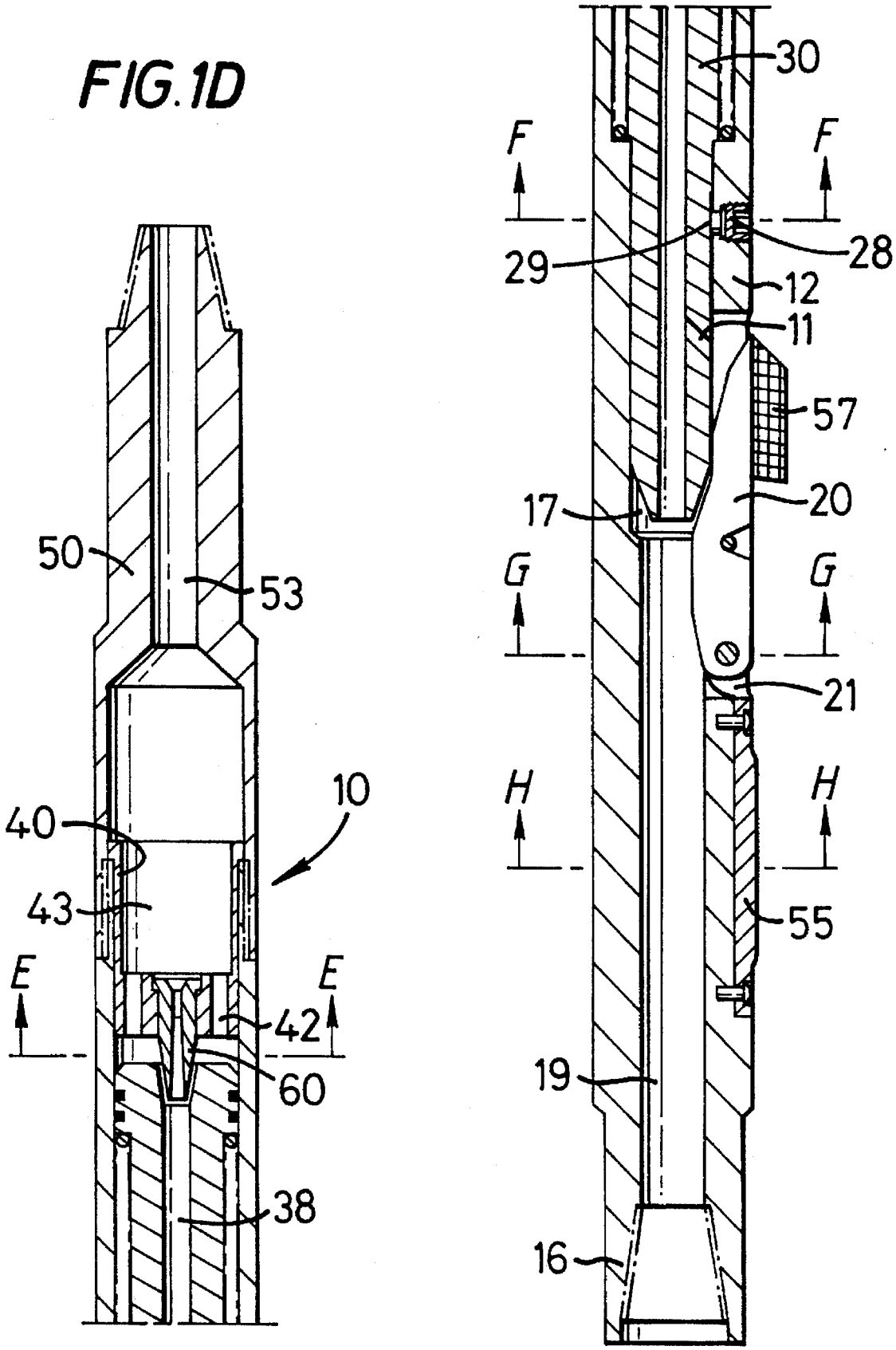
FIG. 1D is another side view in cross-section of the milling system of FIG. 1A.
Figure 1E:
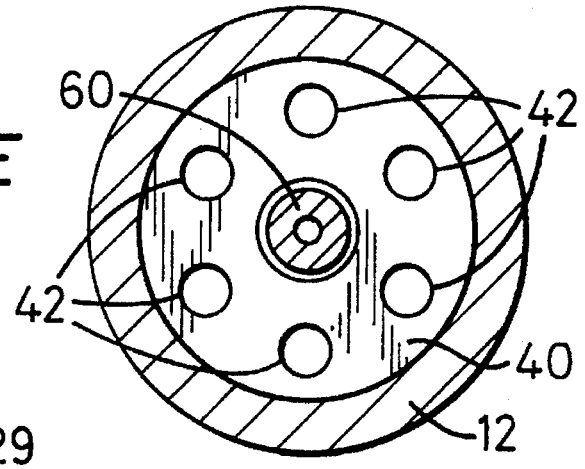
FIG. 1E is a cross-sectional view along line E—E of FIG. 1D.

As shown in FIG. 1D, as the wash tube 30 moves down to its lowermost position, a small fluid passageway opens up between the exterior of the fluid flow nozzle 60 and the interior of the top of the fluid flow bore 38 of the wash tube 30, allowing an indication that "cut out" has been achieved and allowing for greater fluid flow. The wash tube 30 may have one or more fluid flow passages 11 near its lower end so that when the wash tube 30 is in the position of FIG. 1D fluid flows out to facilitate cuttings removal and inhibit cuttings from accumulating in the tool.

FIG. 2 illustrates three blades 20 in extended position. The blades 20 are equispaced (every 120°) around the hollow mill body 12.

Figure 1F:
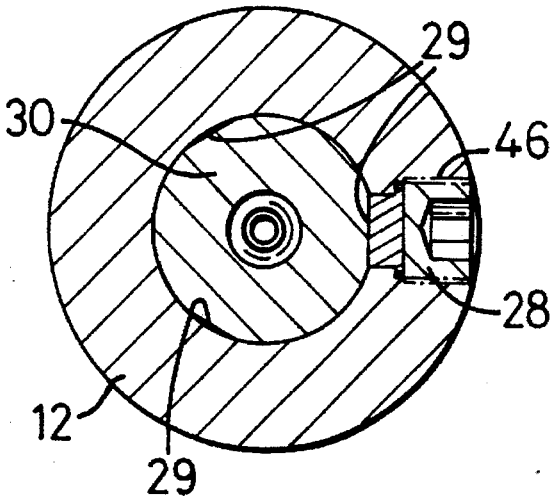
FIG. 1F is a cross-sectional view along line F—F of FIG. 1D.
Figure 1G:
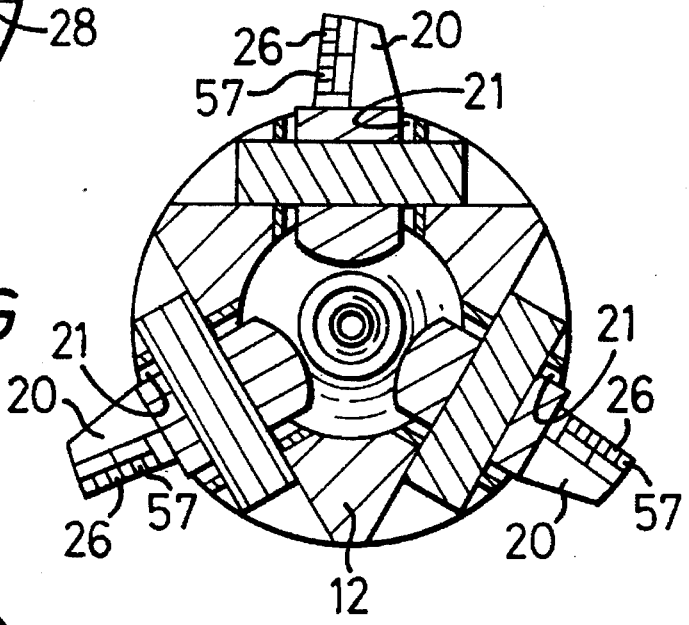
FIG. 1G is a cross-sectional view along line G—G of FIG. 1D.

FIG. 1F shows one pin 28 threadedly and removably engaged in a hole 46 in the hollow mill body 12 with a small space between it and the flat surface 29.

Figure 1H:
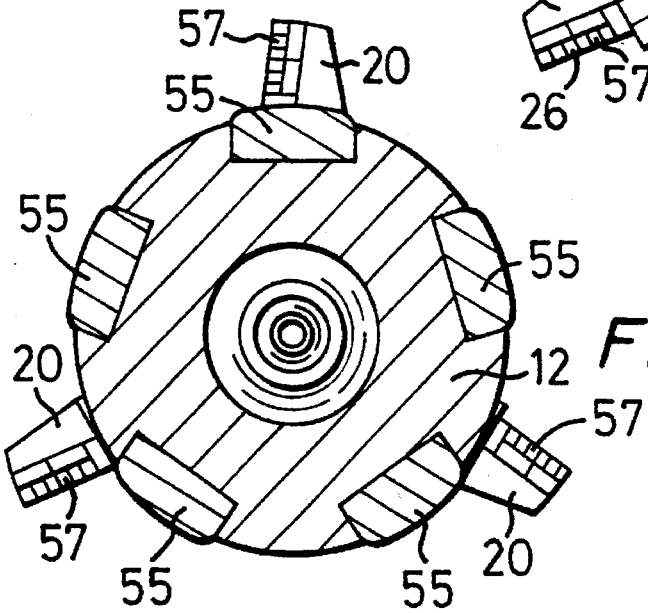
FIG. 1H is a cross-sectional view along line H—H of FIG. 1D.

FIG. 1H shows three extended blades 20 and a plurality of stabilizers 55 projecting from the mill body 12 and removably secured thereto with bolts 56 (FIG. 1A). Cutting inserts 57 cover the top end portion of the blades 20.

Figure 2A:
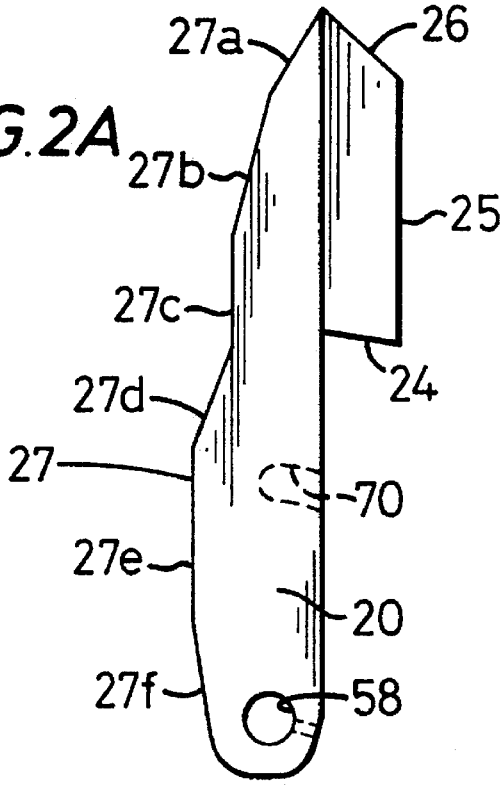
FIG. 2A is a side view of a blade of the milling system shown in FIG. 1A.
Figure 2B:
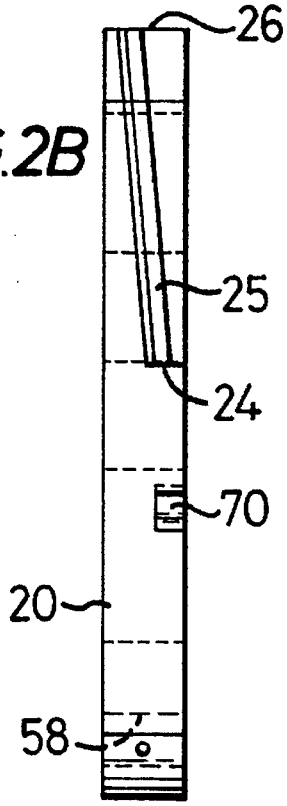
FIG. 2B is a front view of the blade of FIG. 2A.
Figure 2C:
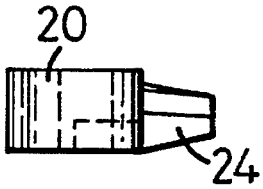
FIG. 2C is a bottom view of the blade of FIG. 2A.

FIGS. 2A–2C show a blade 20 according to the present invention with its cutting/milling surface 25 disposed so that when the blade 20 is fully extended (as in FIG. 1D) the surface 25 is substantially parallel to a longitudinal axis running up and down through the hollow mill body 12. With this disposition a major part (and preferably substantially all) of the surface 25 contacts a tubular's, e.g. casing's, interior surface for efficient and effective milling. A recess 70 moves about a pin 72 (FIG. 1A) to limit the extent of outward movement of the blade 20 from the hollow mill body 12. A hole 58 receives the pin 23 and a hole 59 receives a set screw (not shown). The blade's top end with the various cutting surfaces may be canted as shown in FIG. 2B (e.g. at a negative rake angle, e.g. about 5°) with respect to the blade body. The interior blade surface comprises six sub-surfaces 27*a*–27*f*. These surfaces are sized, disposed, and configured for co-action with the exterior surface of the wash tube 30 to effect desired outward blade movement and disposition. Initially the nose 37 of the wash tube 30 moves down against the sub-surface 27*a* (see FIG. 1B). The wash tube's exterior surface then moves down against the sub-surface 27*b* (see FIG. 1C). Then the wash tube's exterior surface moves down against the sub-surface 27*c*. The sub-surfaces 27*d* define a space which receives the nose 37 of the wash tube 30.

Cutting surfaces of a milling system according to the present invention (including, but not limited to cutting surfaces as shown for the blades in the drawings hereof) may be heat treated and/or hardfaced according to any known method; and/or part or all of such surfaces may have any cutting insert or inserts as known in the prior art arranged on the blades in any arrangement or pattern disclosed in the prior art. It is also within the scope of this invention to employ cutting inserts as disclosed in the U.S. Application entitled "Wellbore Milling Tools And Inserts" filed on even date herewith and co-owned with this application which is incorporated fully herein for all purposes.

In certain aspects the system 10 is used with a "shock sub" positioned above the top sub 50 to absorb shocks and reduce vibrations.

FIGS. 3–6 show other configurations for the blades according to the present invention with different structures for securing their bottom ends to the hollow mill body 12.

Figure 3:
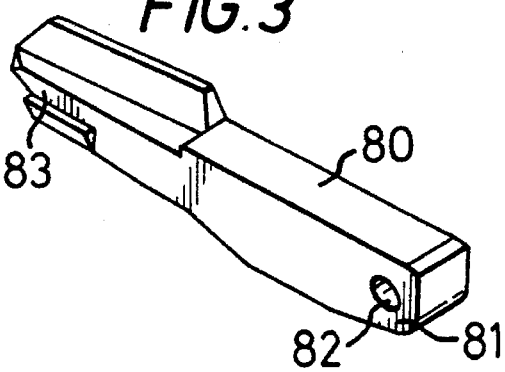
FIG. 3 is a perspective view of a blade according to the present invention.

FIG. 3 shows a blade 80 with a bottom 81 having a hole 82 therethrough for receiving a pin (not shown) for securing the blade to a hollow mill body. A bar stop 83 moves in a slot in the hollow mill body to abut a stop projecting from the hollow mill body to stop the blade's outward movement at a desired position.

Figure 4:
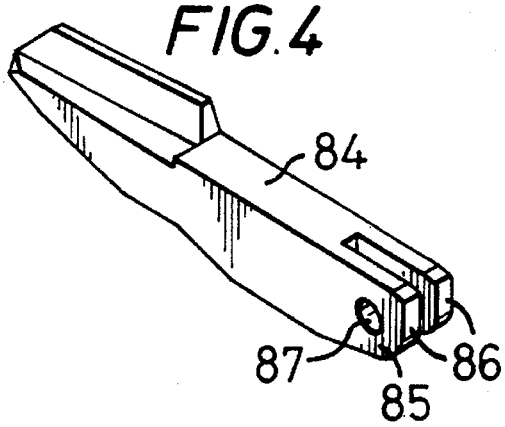
FIG. 4 is a perspective view of a blade according to the present invention.

FIG. 4 shows a blade 84 with a bottom 85, spaced apart tongues 86, and holes 87 for receiving a pin (not shown) for securing the blade to a hollow mill body.

Figure 5:
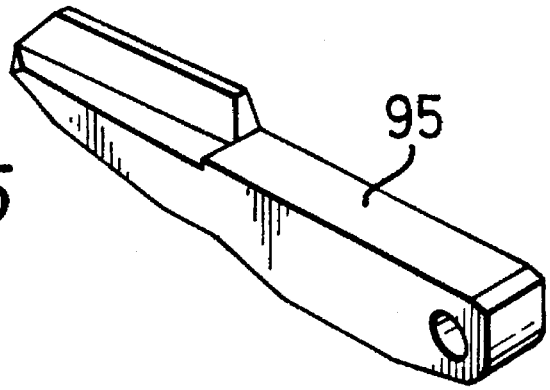
FIG. 5 is a perspective view of a blade according to the present invention.

FIG. 5 shows a blade 95 like the blade 20.

Figure 6:
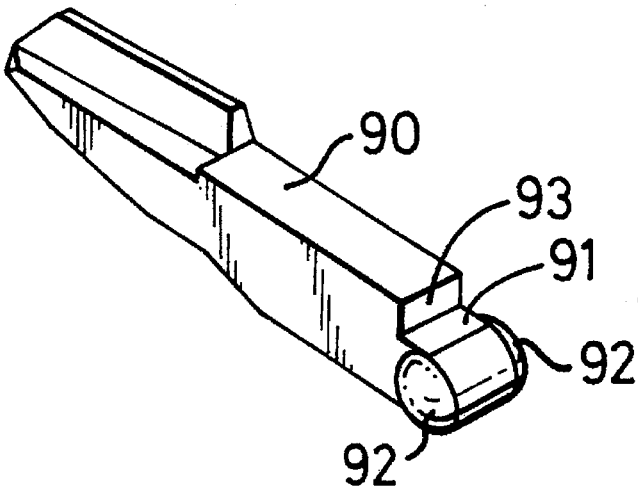
FIG. 6 is a perspective view of a blade according to the present invention.

FIG. 6 shows a blade 90 with a bottom 91 having projecting nubs 92 for receipt within corresponding sockets (not shown) in a mill body to secure the blade 90 in a hollow mill body. A stop 92 abuts a stop on a mill body to arrest blade outward movement and maintain desired extended blade position.

Figure 7:
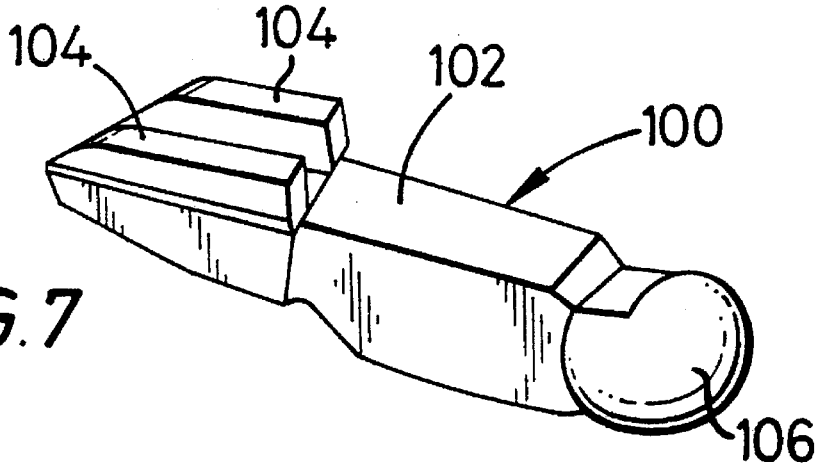
FIG. 7 is a perspective view of a blade according to the present invention.

FIG. 7 shows a blade 100 with a blade body 102, two cutting portions 104 and a spherical mounting end 106. The end 106 fits in an appropriately configured recess in a mill body (not shown) so that it is movable with respect to the body and held in the recess.

Any of the bodies shown in FIGS. 2A, 3–6 may, according to this invention, have two or three blades extending from a single body; e.g. the blade 20 may have multiple side-by-side milling spaced-apart surfaces, each including the three milling surfaces 24, 25, and 26.

In conclusion, therefore, it is seen that the present invention and the embodiments disclosed herein and those covered by the appended claims are well adapted to carry out the objectives and obtain the ends set forth. Certain changes can be made in the described and in the claimed subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form its principles may be utilized.

What is claimed is:

1. A milling apparatus comprising a hollow mill body, at least one blade within the hollow mill body the or each blade having a blade body, a top, a bottom, and a cutter with a cutting surface, the or each blade bottom rotatably secured by a securement to the hollow mill body for rotation outwardly from the hollow mill body, means for moving the at least one blade from the body, the means for moving the at least one blade from the body comprising a wash tube movably disposed in the hollow mill body above the at least one blade, the wash tube movable downwardly in response to the force of fluid flowing into the section milling apparatus to contact the at least one blade and move the top of the at least one blade outwardly from the hollow mill body as the at least one blade rotates about its securement, and means for indicating when cut out has been achieved by the at least one blade.

2. The milling apparatus of claim 1 wherein the wash tube has a tube central flow channel for the flow of fluid therethrough, and wherein the means for indicating when cut out has been achieved comprises a hollow tubular sleeve movably disposed in the hollow mill body above the wash tube, the hollow tubular sleeve movable by fluid flowing through the milling apparatus to contact the wash tube, the hollow tubular sleeve having a central member and a flow channel around the central member between an exterior surface of the central member and an interior surface of the hollow tubular sleeve, the central member having a central channel therethrough, and a flow nozzle secured in the central channel of the hollow tubular sleeve with a nozzle portion extending therefrom and directed toward the tube central flow channel of the wash tube through which fluid flows through the wash tube, the flow nozzle receivable within the tube central flow channel.

3. The milling apparatus of claim 1 further comprising the cutting surface of the cutter of the at least one blade has a longitudinal length and extends out from the blade body such that the cutting surface provides full sweep milling for substantially the entire longitudinal length of the cutting surface.

4. The milling apparatus of claim 1 further comprising stop means for holding the at least one blade in position with respect to the hollow mill body for milling.

5. The milling apparatus of claim 1 further comprising a first angled surface on an interior of the at least one blade, and a second angled surface on an exterior of a lower end of the wash tube for contacting the first angled surface on the interior of the at least one blade so that as the wash tube moves downwardly the at least one blade is moved outwardly from the hollow mill body by the wash tube.

6. The milling apparatus of claim 5 further comprising a second surface on the interior of the at least one blade, the second surface disposed so that when the blade is moved to a milling position the second surface is substantially parallel to an exterior surface of the wash tube so that the at least one blade is held in the milling position by the wash tube.

7. The milling apparatus of claim 1 wherein the at least one blade is three blades disposed in the hollow mill body and spaced apart from each other.

8. The milling apparatus of claim 1 further comprising spring means in the hollow mill body for yieldably urging the wash tube upwardly away from the at least one blade.

9. The milling apparatus of claim 1 wherein the wash tube has a central fluid flow channel therethrough and the milling apparatus further comprising at least one fluid flow port through a lower end of the wash tube for flowing fluid past the at least one blade.

10. The milling apparatus of claim 1 further comprising the cutting surface of the at least one blade comprising an upper cutting surface at a top of the cutter and extending outwardly from the blade body, a lower cutting surface at a bottom of the cutter and extending outwardly from the blade body and spaced apart from the upper cutting surface, and a middle cutting surface extending from the upper cutting surface to the lower cutting surface.

11. A blade for a section milling apparatus for milling a tubular member in a wellbore, the blade disposable within and movable outwardly from the milling apparatus to contact and mill the tubular member, the blade comprising a blade body with a top and a bottom, an interior surface, and an exterior surface, a hole in the bottom of the blade for rotatably mounting the blade to a milling apparatus so that the top of the blade is rotatable outwardly from the milling apparatus, a milling surface on the exterior surface of the blade body, a first angled surface on an interior of the blade body for contacting and co-acting with a second angled surface on an exterior of a lower end of an actuating member in the milling apparatus, the second angled surface corresponding to and for contacting the first angled surface on the interior of the blade body so that as the actuating member moves downwardly the blade is moved outwardly from the milling apparatus, and a second surface on the interior of the blade for contacting the actuating member so that when the blade is moved to a milling position the second surface is substantially parallel to an exterior surface of the actuating member so that the blade is held in a milling position by the actuating member.

12. The blade of claim 11 further comprising stop means on the blade body for contacting another member to stop movement of the blade out from the milling apparatus.

13. A milling method for milling a casing in a wellbore, the method comprising introducing a milling apparatus into a wellbore into a casing to be milled, the milling apparatus comprising a hollow mill body, at least one blade within the hollow mill body, the or each blade having a top, a bottom, and a cutting surface, the or each blade bottom rotatably secured by a securement to the hollow mill body for rotation of the blade outwardly from the hollow mill body means for indicating when cutout has been achieved by the at least one blade, and means for moving the at least one blade from the body, positioning the milling apparatus at a desired location in the casing, moving the means for moving the at least one blade downwardly to move the at least one blade outwardly from the hollow mill body against an interior of the casing, rotating the milling apparatus to mill the casing with the at least one blade, and indicating when cutout has been achieved by the at least one blade.

14. The method of claim 13 further comprising effecting full sweep milling of the casing, the cutting surface of the at least one blade having an extension out from the blade body, said extension such that the cutting surface of the at least one blade provides full sweep milling for substantially an entire longitudinal length of the cutting surface.

15. The method of claim 14 wherein the means for moving the at least one blade has a lower end and the method further comprising biasing the lower end of the means for moving against an interior of the at least one blade during milling.

16. A milling apparatus comprising a hollow mill body, at least one blade within the hollow mill body the or each blade having a blade body, a top, a bottom, and a cutter with a cutting surface, the or each blade bottom rotatably secured by a securement to the hollow mill body for rotation outwardly from the hollow mill body, means for moving the at least one blade from the body, and each of the at least one blade urged into the hollow mill body by a spring.

* * * * *